US009416669B2

(12) United States Patent
Batt et al.

(10) Patent No.: US 9,416,669 B2
(45) Date of Patent: Aug. 16, 2016

(54) TURBINE AIRFOIL AND METHOD FOR THERMAL BARRIER COATING

(75) Inventors: Stephen Batt, Lincoln (GB); Scott Charlton, Newark (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 627 days.

(21) Appl. No.: 13/812,207

(22) PCT Filed: Jul. 8, 2011

(86) PCT No.: PCT/EP2011/061640
§ 371 (c)(1),
(2), (4) Date: Jan. 25, 2013

(87) PCT Pub. No.: WO2012/016789
PCT Pub. Date: Feb. 9, 2012

(65) Prior Publication Data

US 2013/0121839 A1 May 16, 2013

(30) Foreign Application Priority Data

Aug. 5, 2010 (EP) ..... 10171964

(51) Int. Cl.
*F01D 5/18* (2006.01)
*F01D 9/06* (2006.01)
*F01D 5/28* (2006.01)

(52) U.S. Cl.
CPC ..... *F01D 5/288* (2013.01); *F01D 5/187* (2013.01); *F01D 9/06* (2013.01); *F05D 2230/90* (2013.01); *F05D 2240/122* (2013.01); *F05D 2240/304* (2013.01); *F05D 2250/292* (2013.01)

(58) Field of Classification Search
CPC ..... F01D 5/286; F01D 5/288; F01D 25/007; F01D 5/186; F01D 5/187; F01D 9/06; F05D 2230/90; F05D 2240/304; F05D 2240/305; F05D 2260/95; F05D 2300/611; F05D 2240/122; F05D 2240/123; F05D 2260/20; F05D 2260/202
USPC ..... 415/115, 175–178, 200; 416/96 R, 96 A, 416/97 R, 241 R, 241 B
See application file for complete search history.

(56) References Cited

U.S. PATENT DOCUMENTS

| | | | | |
|---|---|---|---|---|
| 4,121,894 | A | 10/1978 | Bernardo | |
| 4,447,188 | A * | 5/1984 | Davis et al. | 415/115 |
| 6,077,036 | A | 6/2000 | Carson | |
| 6,126,400 | A | 10/2000 | Nichols | |
| 6,197,424 | B1 | 3/2001 | Lane | |

(Continued)

FOREIGN PATENT DOCUMENTS

| | | | |
|---|---|---|---|
| CA | 2327203 | A1 | 6/2001 |
| CN | 101128649 | A | 2/2008 |

(Continued)

*Primary Examiner* — Christopher Verdier

(57) ABSTRACT

A turbine airfoil including an airfoil body is disclosed. The airfoil includes a leading edge, a trailing edge, an exterior surface including a suction side extending from the leading edge to the trailing edge and a pressure side extending from the leading edge to a trailing end. The pressure side is located opposite to the suction side on the airfoil body. The complete pressure side of the exterior surface is coated by a thermal barrier coating with a thickness decreasing towards the trailing end.

4 Claims, 2 Drawing Sheets

(56) References Cited

U.S. PATENT DOCUMENTS

| | | | | |
|---|---|---|---|---|
| 6,328,531 | B1 | 12/2001 | Bariaud et al. | |
| 6,382,920 | B1 * | 5/2002 | Dopper | 416/241 R |
| 2003/0108424 | A1 * | 6/2003 | Masaki | 416/97 R |
| 2007/0253817 | A1 * | 11/2007 | Bezencon et al. | 416/97 R |
| 2008/0199317 | A1 * | 8/2008 | Spangler et al. | 416/95 |
| 2009/0104356 | A1 | 4/2009 | Marszal | |
| 2009/0194356 | A1 | 8/2009 | Kato | |
| 2010/0014962 | A1 | 1/2010 | Arrieta | |
| 2010/0119372 | A1 * | 5/2010 | Gage et al. | 416/223 R |

FOREIGN PATENT DOCUMENTS

| | | | |
|---|---|---|---|
| EP | 1106782 | A2 | 6/2001 |
| EP | 1544414 | A1 | 6/2005 |
| EP | 15444141 | A1 | 6/2005 |
| RU | 2072058 | C1 | 1/1997 |
| RU | 2076927 | C1 | 4/1997 |
| WO | WO 9810174 | A1 | 3/1998 |
| WO | WO 9948837 | A1 | 9/1999 |
| WO | WO 2008043340 | A1 | 4/2008 |

* cited by examiner

TURBINE AIRFOIL AND METHOD FOR THERMAL BARRIER COATING

CROSS REFERENCE TO RELATED APPLICATIONS

This application is the US National Stage of International Application No. PCT/EP2011/061640, filed Jul. 8, 2011 and claims the benefit thereof. The International Application claims the benefits of European Patent Office application No. 10171964.9 EP filed Aug. 5, 2010. All of the applications are incorporated by reference herein in their entirety.

FIELD OF INVENTION

The present invention relates to a turbine airfoil which can be used in a gas turbine vane or blade. It further relates to a method for thermal barrier coating of a turbine airfoil.

BACKGROUND OF INVENTION

The airfoils of gas turbines are typically made of nickel or cobalt based superalloys which show high resistance against the hot and corrosive combustion gases present in gas turbine. However, although such superalloys have considerably high corrosion and oxidation resistance, the high temperatures of the combustion gases in gas turbines require measures to improve corrosion and/or oxidation resistance further. Therefore, airfoils of gas turbine blades and vanes are typically at least partially coated with a thermal barrier coating system to prolong the resistance against the hot and corrosive environment. In addition, airfoil bodies are typically hollow so as to allow a cooling fluid, typically bleed air from the compressor, to flow through the airfoil. Cooling holes present in the walls of the airfoil bodies allow a certain amount of cooling air to exit the internal passages so as to form a cooling film over the airfoil surface which further protects the superalloy material and the coating applied thereon from the hot and corrosive environment. In particular, cooling holes are present at the trailing edges of the airfoils as it is shown in U.S. Pat. No. 6,077,036, U.S. Pat. No. 6,126,400, US 2009/0194356 A1 and WO 98/10174, for example.

Trailing edge losses are a significant fraction of the over all losses of a turbo machinery blading. In particular, thick trailing edges result in higher losses. For this reason, cooled airfoils with a cutback design at the trailing edge have been developed. This design is realised by taking away material on the pressure side of the airfoil from the trailing edge up to several millimeters towards the leading edge. This measure provides very thin trailing edges which can provide big improvements on the blading efficiency. An airfoil with a cutback design and a thermal barrier coating is, for example, disclosed in WO 98/10174 A1. However, the beneficial effect on the efficiency can only be achieved if the thickness of the trailing edge is rather small. On the other hand, for a blade with thermal barrier coating the combined thickness of the cast airfoil body wall and the applied thermal barrier coating system exceeds the optimum thickness of the design. In addition, as the flow velocity of the gas is the greatest at the trailing edge of the airfoil a thermal barrier coating applied to the trailing edge is prone to high levels of erosion.

It is known to selectively provide a thermal barrier coating system to the airfoil, in particular such that the trailing edge of an airfoil and adjacent regions of an airfoil remain uncoated. Selective coatings are, for example, described in U.S. Pat. No. 6,126,400, U.S. Pat. No. 6,077,036 and, with respect to the coating method, in US 2009/0104356 A1.

However, in U.S. Pat. No. 6,077,036 the pressure side of the airfoil is completely uncoated which means that areas which would not suffer from a higher combined thickness of the cast airfoil body and the coating applied thereon remain unprotected against the temperature the hot combustion gas.

WO 2008/043340 A1 and US 2010/0014962 A1 describe a turbine airfoil with a thermal barrier coating the thickness of which varies over the airfoil surface. Starting from the flow inlet edge, the layer thickness of the thermal barrier coating on the pressure side decreases continuously in the direction of a flow outlet edge, wherein no thermal barrier coating is preferably applied to the pressure side directly adjacent to the flow outlet edge so that in a section of the pressure side, which as a rule is provided with cooling air exits, the layer thickness of the thermal barrier coating is approximately zero. Part of the pressure side close to the cutback or air gap between the pressure side and the suction side is left uncoated.

In U.S. Pat. No. 6,126,400 the thermal barrier coating only covers about half of the airfoil, as seen from the leading edge towards the trailing edge.

In WO 99/48837 a ceramic composition for insulating components, made of ceramic matrix composites, of gas turbines is provided.

EP 1 544 414 A1 discloses an inboard cooled nozzle doublet, wherein a doublet of hollow vanes is integrally joined between two bands of a turbine nozzle. The vanes comprise rows of trailing edge outlets.

In U.S. Pat. No. 4,121,894 a refurbished turbine vane or blade is disclosed. The refurbished turbine vane or blade comprises an overlay metal which has been added to the vane surfaces by a plasma spray process and thereafter refinished to conform to the original contours as specified for new vanes. The overlay metal can be applied to build up a thickness of as much as 30 to 40 thousands of an Inch, and can be feathered as the overlay approaches the trailing edge of the vane. This means, that the area around the trailing edge is not covered by the overlay metal.

The trailing edge of an aerofoil requires being as thin as possible due to the considerable aerodynamic losses incurred. On a cooled vane, the target thickness for the trailing edge must include two cast wall thicknesses, an air gap and two thermal barrier coating thicknesses. Due to a minimum casting thickness, the sum of all the thicknesses exceeds the overall target. Previously, a similar part has been left uncoated, hence being subject to higher oxidation.

SUMMARY OF INVENTION

With respect to the mentioned prior art it is a first objective of the present invention to provide an advantageous airfoil. It is a second objective to provide an advantageous turbine blade or vane. A third objective of the present invention is to provide an advantageous method for thermal barrier coating a turbine airfoil.

The first objective is solved by a turbine airfoil as claimed in the claims. The second objective is solved by a turbine vane or blade as claimed in the claims. The second objective is solved by a method for thermal barrier coating a turbine airfoil as claimed in the claims. The depending claims contain further developments of the invention.

The inventive turbine airfoil comprises an airfoil body. The airfoil body comprises a leading edge, a trailing edge, a cutback and an exterior surface. The exterior surface includes a suction side which extends from the leading edge to the trailing edge. The exterior surface further includes a pressure side. The pressure side extends from the leading edge to the trailing edge or to a trailing end. The trailing end is identical with the trailing edge if there is no cutback or air gap between the pressure side and the suction side close to the trailing edge. If there is a cutback or an air gap between the pressure side and the suction side, then the pressure side does not extend completely to the trailing edge of the turbine airfoil. Therefore, in the context of the present invention the end of the pressure side close to the trailing edge is designated as trailing end. In other words, the end of the pressure side at the cutback or air gap in chord direction, which proceeds from the leading edge to the trailing edge, is designated as trailing end.

The cutback may be realised by taking away material on the pressure side of the airfoil from the trailing edge, for example up to several millimeters, towards the leading edge. This provides very thin trailing edges which can provide big improvements on the blading efficiency.

The pressure side is located opposite to the suction side on the airfoil body. In the inventive turbine airfoil the complete pressure side of the exterior surface is coated by a thermal barrier coating. The thermal barrier coating comprises a thickness which is decreasing towards the trailing end. For example, the thermal barrier coating can be tapered towards the trailing end. The use of a tapered thermal barrier coating may result in the minimum casting thickness to be retained. At the same time the overall thickness target can be achieved. This has the advantage that the aerodynamic efficiency of the airfoil is maintained and the coating is more reliable.

Preferably, the thickness of the thermal barrier coating may continuously, for instance linearly, decrease towards the trailing end.

The inventive turbine airfoil comprises a cutback or an air gap between the pressure side and the suction side. The cutback or air gap can be located between the trailing edge and the trailing end. Furthermore, the complete suction side of the exterior surface can be coated by a thermal barrier coating.

A turbine vane typically comprises an airfoil or airfoil portion which is located between two platforms. A turbine blade typically comprises an airfoil or airfoil portion which is connected to at least one platform. The vane or blade may further comprise a root portion. The root portion is typically connected to the platform.

The inventive turbine vane or turbine blade comprises a turbine airfoil as previously described. The inventive turbine vane or turbine blade has the same advantages as the inventive turbine airfoil.

The inventive method for thermal barrier coating of a turbine airfoil is related to a turbine airfoil which comprises an airfoil body. The airfoil body comprises a leading edge, a trailing edge, a cutback and an exterior surface. The exterior surface includes a suction side extending from the leading edge to the trailing edge. The exterior surface further comprises a pressure side extending from the leading edge to a trailing end. The trailing end is defined as previously mentioned in the context with the inventive turbine airfoil. The pressure side is located opposite to the suction side on the airfoil body. In the inventive method the complete pressure side of the exterior surface extending from the leading edge to the trailing end is coated by a thermal barrier coating such that the coating thickness decreases towards the trailing end. For example, the coating thickness may be decreased towards the trailing edge or the trailing end. Preferably, the coating thickness can be tapered towards the trailing edge or trailing end.

Preferably, the thickness of the thermal barrier coating may be continuously, for instance linearly, decreased towards the trailing end.

Generally, the inventive turbine airfoil can be manufactured by use of the inventive method. The inventive method has the same advantages as the inventive turbine airfoil.

BRIEF DESCRIPTION OF THE DRAWINGS

Further features, properties and advantages of the present invention will become clear from the following description of an embodiment in conjunction with the accompanying drawings. All mentioned features are advantageous alone or in any combination with each other.

DETAILED DESCRIPTION OF INVENTION

Figure 1:
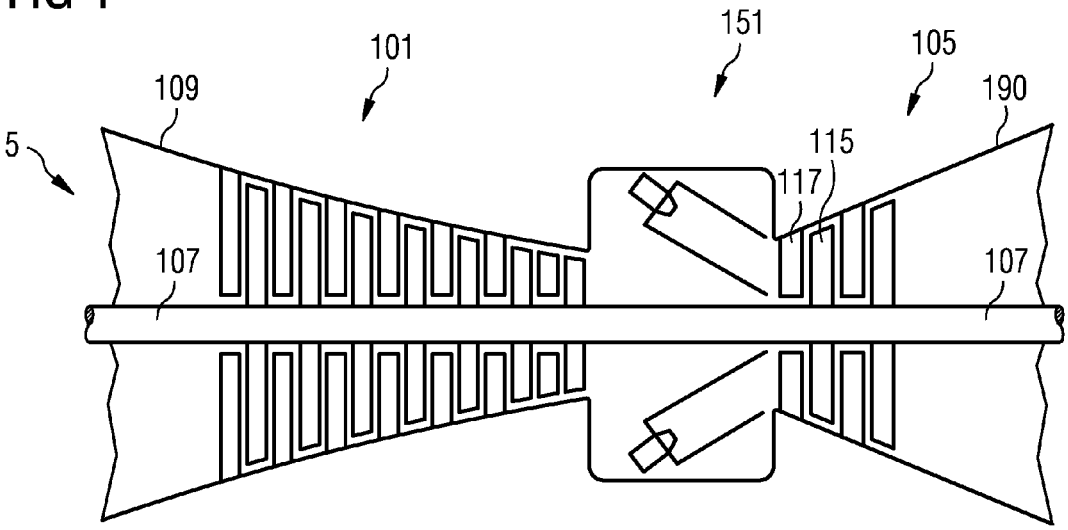
FIG. 1 schematically shows a gas turbine.

FIG. 1 schematically shows a gas turbine 5. A gas turbine 5 comprises a rotation axis with a rotor. The rotor comprises a shaft 107. Along the rotor a suction portion with a casing 109, a compressor 101, a combustion portion 151, a turbine 105 and an exhaust portion with a casing 190 are located.

The combustion portion 151 communicates with a hot gas flow channel which may have a circular cross section, for example. The turbine 105 comprises a number of turbine stages. Each turbine stage comprises rings of turbine blades. In flow direction of the hot gas in the hot gas flow channel a ring of turbine guide vanes 117 is followed by a ring of turbine rotor blades 115. The turbine guide vanes 117 are connected to an inner casing of a stator. The turbine rotor blades 115 are connected to the rotor. The rotor is connected to a generator, for example.

During operation of the gas turbine air is sucked and compressed by means of the compressor 101. The compressed air is led to the combustion portion 151 and is mixed with fuel. The mixture of air and fuel is then combusted. The resulting hot combustion gas flows through a hot gas flow channel to the turbine guide vanes 117 and the turbine rotor blades 115 and actuates the rotor.

Figure 2:
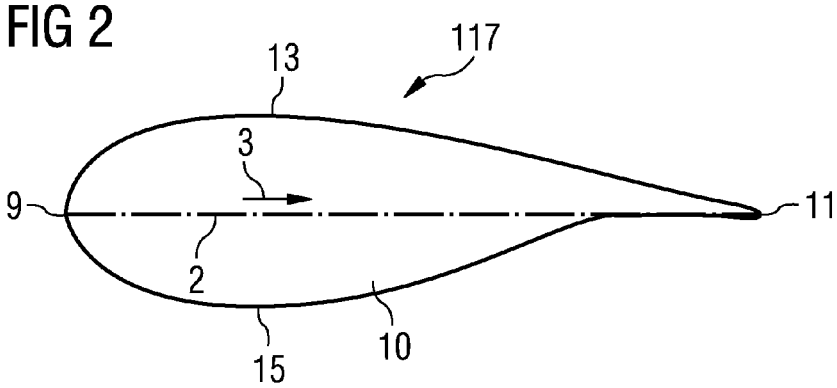
FIG. 2 schematically shows a turbine airfoil in a sectional view.

A chord-wise cross section through the airfoil body 10 of the airfoil 117 is schematically shown in FIG. 2. The aerodynamic profile shown in FIG. 2 comprises a suction side 13 and a pressure side 15. The airfoil 117 further comprises a leading edge 9 and a trailing edge 11. The dash-dotted line extending from the leading edge 9 to the trailing edge 11 shows the chord 2 of the profile. The chord direction 3 proceeds from the leading edge 9 towards the trailing edge 11.

Figure 3:
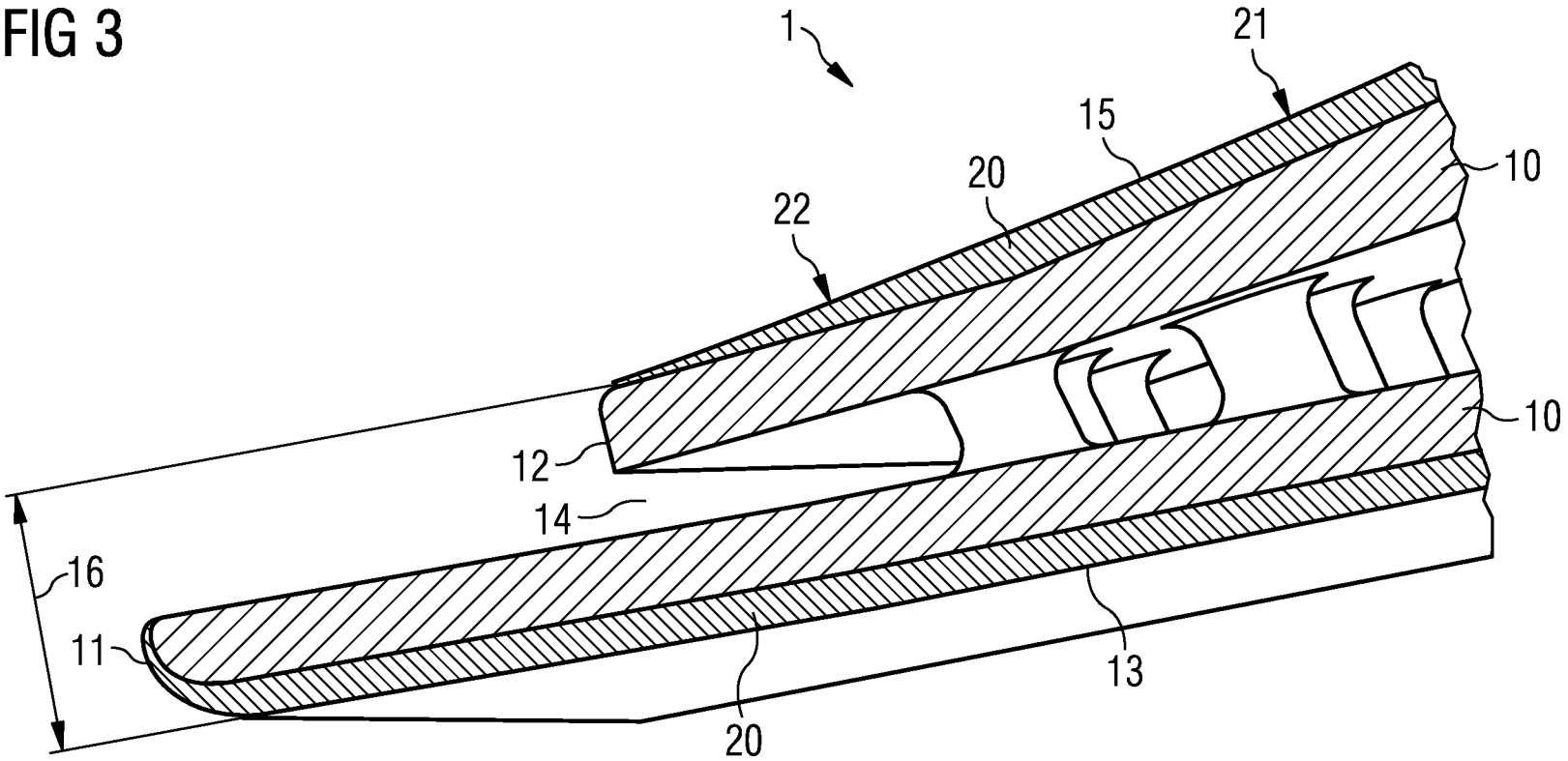
FIG. 3 schematically shows part of an inventive turbine airfoil in a sectional and perspective view.

FIG. 3 schematically shows part of an inventive turbine airfoil in a sectional and perspective view. A cutback or air gap 14 is located between the pressure side 15 and the suction side 13 of the airfoil body 10. The suction side 13 extends from the leading edge 9 to the trailing edge 11. The pressure side 15 extends from the leading edge 9 to the trailing end 12. The trailing end 12 defines the end of the pressure side 15 in chord direction 3.

The suction side 13 and the pressure side 15 are coated by a thermal barrier coating 20. On the pressure side 15 the thermal barrier coating 20 comprises a portion with a constant thickness 21 and a portion with a decreasing coating thickness 22. The portion with the decreasing coating thickness 22 extends from the portion with constant coating thickness 21 to the trailing end 12. The coating thickness in the portion 22 with decreasing coating thickness decreases towards the trailing end 12 down to a minimum coating thickness.

The thickness of the turbine airfoil at the trailing end 12 is indicated by reference numeral 16. The decreasing thickness of the thermal barrier coating 20 towards the trailing end 12 has the advantage, that the portion of the pressure side 15 which is located close to the trailing end 12 is covered by a thermal barrier coating, whilst a minimum trailing edge thickness 16 can be achieved. This means that the portion of the pressure side 15 which is located close to the trailing end 12 must not be left uncoated to achieve an optimal aerodynamic behaviour of the airfoil.

The airfoil 1, which is shown in FIG. 3, can be a turbine vane 117 or a turbine blade 115, for example of a gas turbine 5.

The thickness of the thermal barrier coating in the portion 22 with decreasing coating thickness may advantageously continuously, for example linearly, decrease towards the trailing end 12.

The invention claimed is:

1. A turbine airfoil, comprising:

an airfoil body, comprising:

a leading edge, a trailing edge, an exterior surface including a suction side extending from the leading edge to the trailing edge, a pressure side extending from the leading edge to a trailing end, the pressure side being located opposite to the suction side on the airfoil body, and an air gap located between the trailing end and the trailing edge and extending from the trailing end, wherein the complete pressure side of the exterior surface is coated by a thermal barrier coating with a thickness that linearly decreases towards the trailing end in directions normal to the pressure side on portions of the pressure side between the trailing end and the leading edge that are adjacent to the trailing end.

2. The turbine airfoil as claimed in claim 1, wherein the complete suction side of the exterior surface is coated by a thermal barrier coating.

3. A turbine vane or blade, comprising:

a turbine airfoil according to claim 1.

4. A method for thermal barrier coating of a turbine airfoil, comprising:

providing an airfoil body comprising a leading edge, a trailing edge, an exterior surface including a suction side extending from the leading edge to the trailing edge, a pressure side extending from the leading edge to a trailing end, the pressure side being located opposite to the suction side on the airfoil body, and an air gap located between the trailing end and the trailing edge and extending from the trailing end; and coating the complete pressure side of the exterior surface extending from the leading edge to the trailing end by a thermal barrier coating such that the coating thickness linearly decreases towards the trailing end in directions normal to the pressure side on portions of the pressure side between the trailing end and the leading edge that are adjacent to the trailing end.

* * * * *